United States Patent [19]

Yuasa et al.

[11] Patent Number: 4,762,092

[45] Date of Patent: Aug. 9, 1988

[54] HIGH-DENSITY LIQUID FUEL

[75] Inventors: Hitoshi Yuasa; Mitsuo Matsuno; Tetsuo Satoh, all of Yokohama, Japan

[73] Assignee: Nippon Oil Co., Ltd., Japan

[21] Appl. No.: 17,736

[22] Filed: Feb. 24, 1987

[30] Foreign Application Priority Data

Feb. 24, 1986 [JP] Japan ..... 61-38506

[51] Int. Cl.[4] ..... F02B 75/12; C10L 1/16

[52] U.S. Cl. ..... 123/1 A; 585/14; 585/22

[58] Field of Search ..... 585/14, 22; 123/1 A

[56] References Cited

PUBLICATIONS

Berman et al., CA 81 120088d (1974).

Osawa et al., CA 96 180851s (1982).

*Primary Examiner*—Curtis R. Davis

*Attorney, Agent, or Firm*—Ostrolenk, Faber, Gerb & Soffen

[57] ABSTRACT

The present invention provides a high-density fuel oil which is suitable for rockets and jet engines and which mainly comprises a tetracyclo (7. 3. 1. $O^{2,7}$. $1^{7,11}$) tetradecane derivative represented by the general formula:

(I)

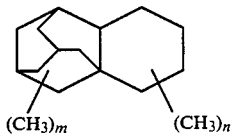

wherein each of m and n is 0, 1 or 2, and the sum of m and n is 2 or less.

6 Claims, No Drawings

HIGH-DENSITY LIQUID FUEL

BACKGROUND OF THE INVENTION (1) Field of the Invention

The present invention relates to a high-energy fuel, and more specifically it relates to a liquid fuel having a high density and a high calorific value which is used in rockets or jet engines.

(2) Description of the Prior Art

In a rocket and a jet engine for a turbo jet, a ram jet, a pulse jet or the like, a high-energy liquid fuel is used. In order to increase thrust of the jet engine, there is required a fuel having a greater combustion energy per unit weight, i.e., a liquid fuel having a high density and a great combustion heat. The liquid fuel for rockets and jet engines is fed through a pipe to a fuel chamber, but since a flying object loaded with the rocket or the jet engine flies at a high altitude and because of being used together with liquid oxygen, the liquid fuel is exposed to an extremely low temperature. Therefore, other requirements which are necessary for the liquid fuel for jet engines are that the freezing point and pour point are low and that a suitable viscosity is retained even at a low temperature. Further, it is also required that the liquid fuel for rockets and jet engines has no unsaturated bonds and is stable during long-term storage.

As such liquid fuels for rockets and jet engines, there are heretofore known exotetrahydrodicyclopentadiene (JP-10, Japanese Patent Publication No. 20977/1970) obtained by isomerizing a hydrogenated dicyclopentadiene with an acid catalyst and a dimerized and then hydrogenated norbornadiene (RJ-5, U.S. Pat. No. 3,377,398). However, JP-10 is good in low-temperature fluidity but has the drawbacks that density is low and that combustion heat per unit volume is small. On the other hand, RJ-5 has a great combustion heat per unit volume, but it is poor in low-temperature fluidity, is difficult to synthesize, and is expensive, inconveniently.

SUMMARY OF THE INVENTION

The inventors of the present application have intensively researched to develop a liquid fuel which can satisfy the above mentioned requirements as the liquid fuel for rockets and jet engines and which can be manufactured easily on an industrial scale, and as a result it has been found that tetracyclo (7. 3. 1. $0^{2,7}$. $1^{7,11}$) tetradecane derivatives are excellent components of liquid fuel oils for rockets and jet engines, and on the basis of such a finding, the present invention has been completed.

That is, the present invention is directed to a high-density fuel oil mainly comprising a tetracyclo (7. 3. 1. $0^{2,7}$. $1^{7,11}$) tetradecane derivative represented by the general formula:

(I)

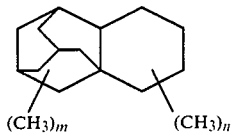

wherein each of m and n is 0, 1 or 2, and the sum of m and n is 2 or less.

DESCRIPTION OF THE PREFERRED EMBODIMENT

The tetracyclo (7. 3. 1. $0^{2,7}$. $1^{7,11}$) tetradecane derivative which can be used as the component of the liquid fuel oil for rockets and jet engines in the present invention has properties such that specific gravity is as high as a level of 0.98 to 1.03 (15° C./4° C.) and net calorific value is as great as a level of 10,000 to 10,400 cal/g. Accordingly, it can be appreciated that the tetracyclo (7. 3. 1. $0^{2,7}$. $1^{7,11}$) tetradecane derivative of the present invention is equipped with the feature that the combustion energy per unit volume is very great, which fact is an important requirement of the liquid fuel for rockets and jet engines.

An additional significant property of the tetracyclo (7. 3. 1. $0^{2,7}$. $1^{7,11}$) tetradecane derivative according to the present invention is that the freezing point is as low as −70° C. or less, through the specific gravity is great as described above. Liquid fuel components having such properties are not present anywhere. There are known some hydrocarbons the specific gravities of which are in excess of 1, such as a dimerized and then hydrogenated norbornadiene which is the main component of RJ-5 mentioned above, but they all have high freezing points and therefore it is hard to make use of them alone as the liquid fuel oils for rockets and jet engines. At present, for this reason, the dimerized and hydrogenated norbornadiene is diluted with a solvent, when used. With regard to the liquid fuel containing such a hydrocarbon with a high freezing point, the hydrocarbon is liable to precipitate, when stored for a long period of time or when exposed to a low temperature during flying, and in the end, such a liquid fuel might cause unexpected accidents. In consequence, it is fair to say that the liquid fuel containing such a compound with a high freezing point as the main component has a serious drawback regarding stability. On the other hand, the tetracyclo (7. 3. 1. $0^{2,7}$. $1^{7,11}$) tetradecane derivative of the present invention itself has as low a melting point as a level of −70° C. or less, so that precipitation does not occur in the liquid fuel oil containing the derivative. In addition, the tetracyclo (7. 3. 1. $0^{2,7}$. $1^{7,11}$) tetradecane derivative of the present invention has no unsaturated bonds and is thus constructed stable, with the result that it is also excellent in oxidative stability. The derivative regarding the present invention can be considered to be the most stable and a high-performance liquid fuel oil component.

In addition to the above mentioned benefits, the tetracyclo (7. 3. 1. $0^{2,7}$. $1^{7,11}$) tetradecane derivative of the present invention which is the main component of the high-density fuel oil can be easily manufactured in a high yield by the use of industrially very readily available and inexpensive materials such as butadiene, isoprene, piperylene, dimethylbutadiene, cyclopentadiene, methycyclopentadiene, dicyclopentadiene, methyldicyclopentadiene, dimethyldicyclopentadiene, a tetrahydroindene series compound and/or an indene series compound. In short, the high-density fuel oil of the present invention is inexpensive and can be manufactured with ease.

There can be manufactured, by the following methods, the tetracyclo (7. 3. 1. $0^{2,7}$. $1^{7,11}$) tetradecane derivative which is the main component of the high-density fuel oil according to the present invention and which is represented by the general formula (I)

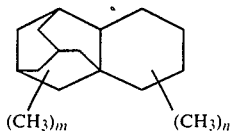

wherein each of m and n is 0, 1 or 2, and the sum of m and n is 2 or less.

In a first method for manufacturing the tetracyclo (7. 3. 1. $0^{2,7}$. $1^{7,11}$) tetradecane derivative (I) of the present invention, there are used, as raw materials, a conjugated diene such as butadiene, isoprene, piperylene or dimethylbutadinene and dicyclopentadiene, methyldicyclopentadiene or dimethyldicyclopentadiene, and reactions progress as follows:

(1)

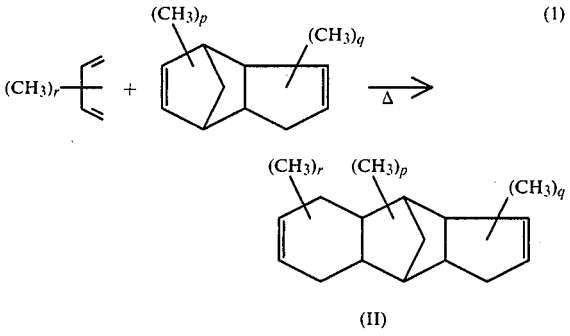

(2)

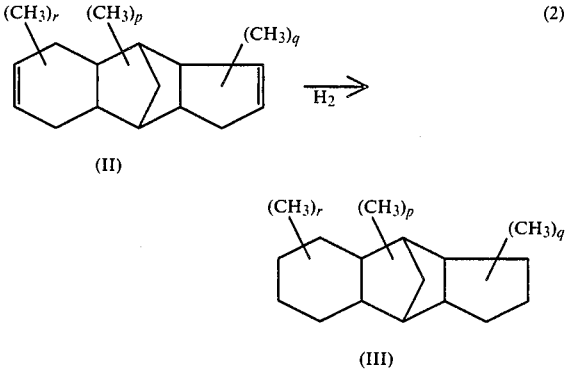

(3)

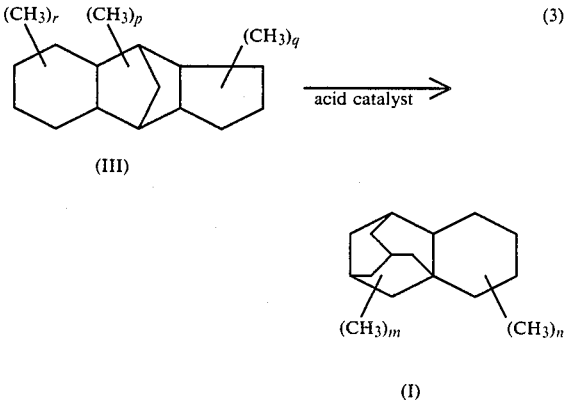

In the above formulae, each of p and q is 0 or 1, and each of r, m and n is 0, 1 or 2. However, $p+q+r \leqq 2$ and $m+n \leqq 2$.

That is, the Diels-Alder reaction is carried out between a conjugated diene such as butadiene, isoprene, piperylene or dimethylbutadinene and a dienophile such as dicyclopentadiene, methyldicyclopentadiene or dimethyldicyclopentadiene, in order to synthesize a 1:1 adduct (II), and the latter is then hydrogenated to obtain a tetracyclo (6. 5. 1. $0^{2,7}$. $0^{9,13}$) tetradecane derivative (III), followed by the isomerization of the compound (III) by the use of an acid catalyst in order to prepare the tetracyclo (7. 3. 1. $0^{2,7}$. $1^{7,11}$) tetradecane derivative (I).

In another method for manufacturing the tetracyclo (7. 3. 1. $0^{2,7}$. $1^{7,11}$) tetradecane derivative (I), there are used, as raw materials, a tetrahydroindene derivative and a cyclopentadiene or methylcyclopentadiene, and reactions progress as described hereinafter. In this case, in place of cyclopentadiene or methylcyclopentadiene, there may be used dicyclopentadiene, methyldicyclopentadiene or dimethyldicyclopentadiene which can produce its monomer, when thermally decomposed under reaction conditions.

(4)

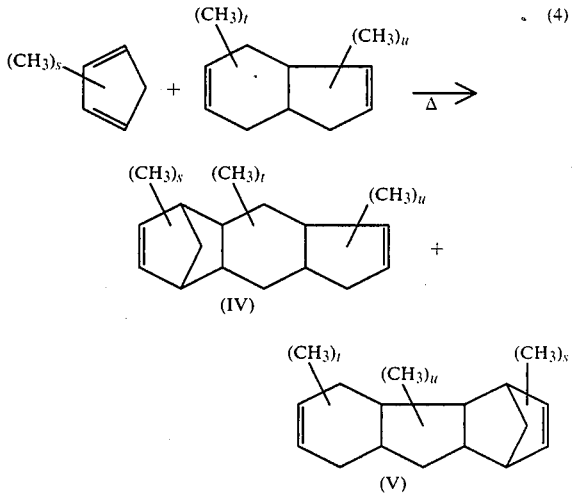

(5)

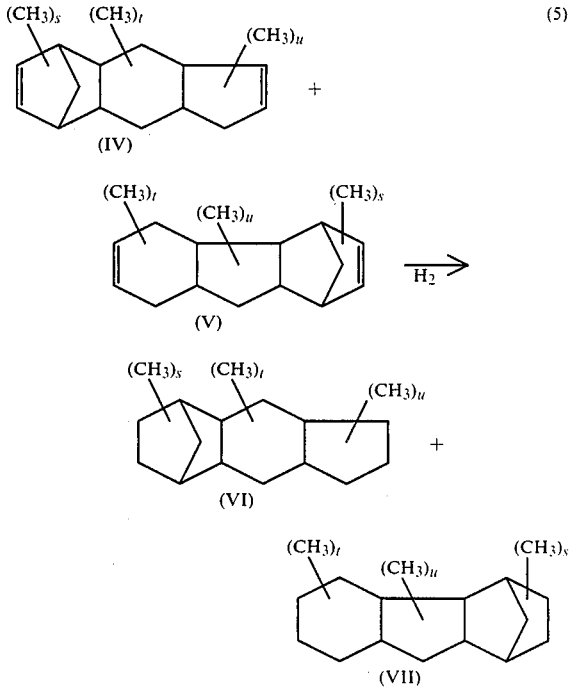

-continued (6)

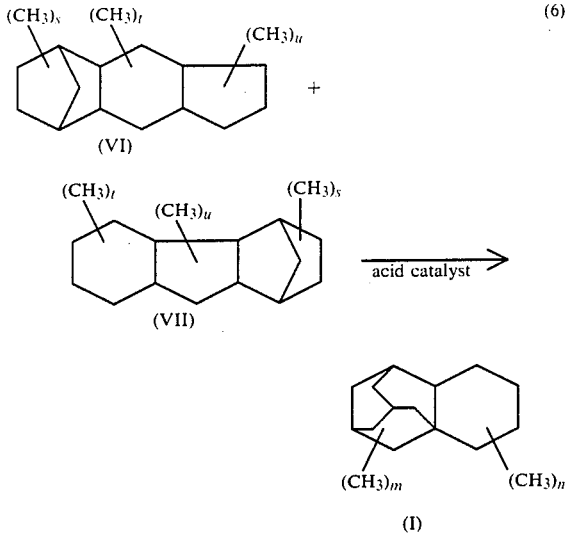

In the above formulae, each of s, t and u is 0 or 1, and each of m and n is 0, 1 or 2. However, $s+t+u \leqq 2$ and $m+n \leqq 2$.

That is, the Diels-Alder reaction is carried out between cyclopentadiene or methylcyclopentadiene and a tetrahydroindene derivative to synthesize 1:1 adducts (IV) and (V) of cyclopentadiene or methylcyclopentadiene and the tetrahydroindene derivative, and the adducts are then hydrogenated to form tetracyclo (7. 4. 0. $0^{3,7}$. $1^{10,13}$) tetradecane derivative (VI) and tetracyclo (7. 4. 0. $0^{2,7}$. $1^{3,6}$) tetradecane derivative (VII). Afterward, the latter are isomerized with the aid of an acid catalyst in the previous manner in order to convert them into a tetracyclo (7. 3. 1. $0^{2,7}$. $1^{7,11}$) tetradecane derivative (I). In this case, the tetracyclo (7. 4. 0. $0^{3,7}$. $1^{10,13}$) tetradecane derivative (VI) and the tetracyclo (7. 4. 0. $0^{2,7}$. $1^{3,6}$) tetradecane derivative (VII) can be both isomerized into the tetracyclo (7. 3. 1. $0^{2,7}$. $1^{7,11}$) tetradecane derivative (I) by the acid catalyst, and therefore the compounds (VI) and (VII) can be used directly in the form of a mixture without any separation.

The tetracyclo (7. 3. 1. $0^{2,7}$. $1^{7,11}$) tetradecane derivative (I) of the present invention can also be manufactured by using, as raw materials, an indene derivative and cyclopentadiene or methylcyclopentadiene in accordance with a process described hereinafter. Incidentally, in place of cyclopentadiene or methylcyclopentadiene, there may be used dicyclopentadiene, methyldicyclopentadiene or dimethyldicyclopentadiene which can produce its monomer, when thermally decomposed under reaction conditions.

(7)

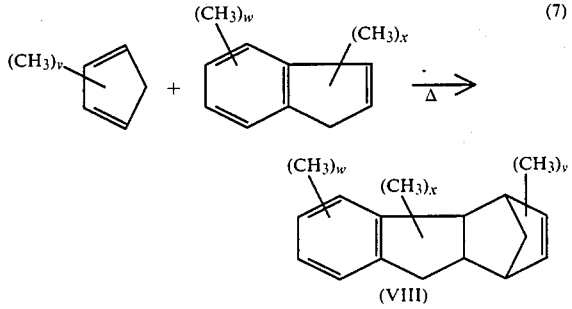

-continued (8)

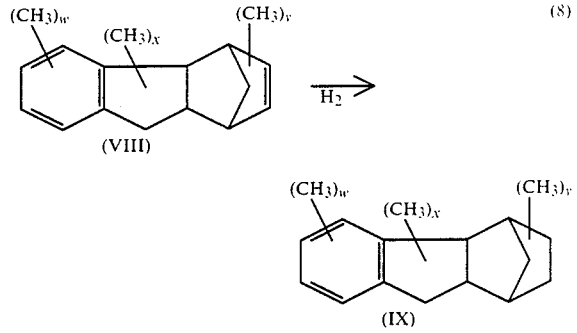

(9)

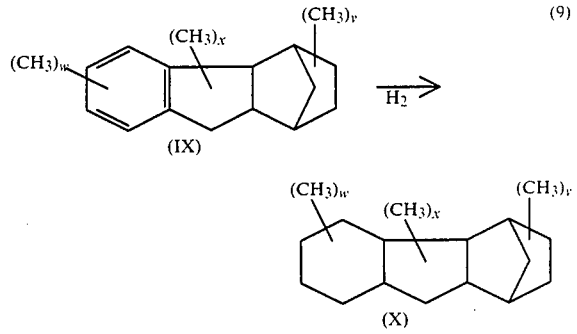

(10)

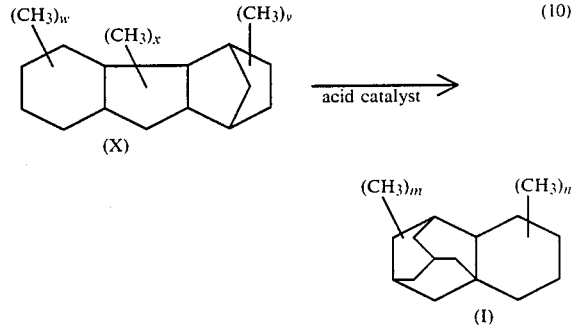

In the above formulae, each of v, w and x is 0 or 1, and each of m and n is 0, 1 or 2. However, $v+w+x \leqq 2$ and $m+n \leqq 2$.

That is, the Diels-Alder reaction is carried out between cyclopentadiene or methylcyclopentadiene and the indene derivative to synthesize a 1:1 adduct (VIII), and the latter is then hydrogenated to form tetracyclo (7. 4. 0. $0^{2,7}$. $1^{3,6}$) tetradecane derivative (X), followed by the isomerization of the compound (X).

As for the reactions of the formula (1) of using butadiene, isoprene, piperylene or dimethylbutadinene and dicyclopentadiene, methyldicyclopentadiene or dimethyldicyclopentadiene, the formula (4) of using cyclopentadiene or methylcyclopentadiene and the tetrahydroindene derivative, and the formula (7) of using the indene derivative, these reactions are the Diels-Alder reactions in which control is achieved by heat alone and in which catalyst is not required, which fact is convenient and very economical. Further, in the formulae (4) and (7), cyclopentadiene or methylcyclopentadiene may be added, as its monomer, to the reaction system, but as a raw material, there may be used dicyclopentadiene, methyldicyclopentadiene or dimethyldicyclopentadiene which can produce cyclopentadiene or methylcyclopentadiene, when thermally decomposed under reaction conditions.

With regard to molar ratios of the diene to the dienophile in the respective Diels-Alder reactions in the formulae (1), (4) and (7), in other words, with regard to the molar ratio of butadiene, isoprene, piperylene or dimethylbutadinene to dicyclopentadiene, methyldicyclopentadiene or dimethyldicyclopentadiene in the formula (1), the molar ratio of cyclopentadiene or methylcyclopentadiene, or dicyclopentadiene, methyldicyclopentadiene or dimethyldicyclopentadiene, which can produce its diene when thermally heated, to the tetrahydroindene derivative in the formula (4), and the molar ratio of cyclopentadiene, methylcyclopentadiene, dicyclopentadiene, methyldicyclopentadiene or dimethyldicyclopentadiene to the indene derivative in the formula (7), each molar ratio is within the range of 1:0.001 to 1:100, preferably 1:0.01 to 1:10. In the case that dicyclopentadiene, methyldicyclopentadiene or dimethyldicyclopentadiene is used as the diene in the formulae (4) and (7), the reaction temperature is within the range of 100° to 250° C., preferably 120° to 200° C., and in the case that cyclopentadiene or methylcyclopentadiene is used as the diene in the formulae (4) and (7), and in the case of the foumula (1), the reaction temperature is within the range of −30° to 250° C., preferably 30° to 200° C. The reaction time depends on the employed reaction temperature but is usually within the range of 10 minutes to 40 hours, preferably 30 minutes to 30 hours. In each Diels-Alder reaction, it is preferred that a polymerization inhibitor such as hydroquinone, tert-butyl catechol or p-phenylenediamine is added to the system so as to inhibit the formation of a polymer. Further, these reactions may be carried out in a solvent, for example, a lower alcohol such as methanol or ethanol, or a hydrocarbon such as toluene or cyclohexane which does not disturb the reactions. In performing these Diels-Alder reactions, any reaction procedure of a batch system, a semi-batch system or a continuous system can be employed.

In the respective Diels-Alder reactions, the above mentioned 1:1 adducts are formed, but oligomers such as a trimer, a tetramer and a pentamer of cyclopentadiene or methylcyclopentadiene are formed as by-products. In addition, polymers are also secondarily produced in which butadiene, isoprene, piperylene, dimethylbutadinene, cyclopentadiene and/or methylcyclopentadiene is added to the desired 1:1 adducts.

These hydrogenated by-products have high melting points and are poor in a low-temperature, fluidity, and therefore, if a liquid fuel oil for jet engines is contaminated with such by-products, its performance will decline and the thus contaminated liquid fuel oil cannot be used on occasion. Accordingly, in order to synthesize the liquid fuel having a high density, a high calorific value and a good fluidity at a low temperature in the present invention, it is necessary to separate the respective 1:1 adducts from the Diels-Alder reaction products obtained under the above mentioned reaction conditions and to purify them, by means of a distillation or the like.

Hydrogenation reaction of the 1:1 adduct (II), (IV), (V) or (VIII) which has been synthesized, separated and purified in the above manner can be performed under the same conditions as in a usual hydrogenation reaction for an unsaturated hydrocarbon compound. That is, the hydrogenation reaction can be easily achieved at a temperature of 20° to 225° C. under a hydrogen pressure of 1 to 200 kg/cm$^2$ in the presence of a hydrogenation reaction catalyst, for example, a noble metal catalyst such as platinum, palladium, rhodium or ruthenium, or a Raney nickel. Further, this hydrogenation reaction may be carried out in the absence or presence of a solvent such as a hydrocarbon, an alcohol, an ester or an ether. After the hydrogenation reaction of the 1:1 adduct has been completed, the resulting hydrogenated product thereof is separated from a mixture of the used solvent, the unreacted materials, the residue of the catalyst, and trace amounts of decomposed products in a certain case, by means of distillation, filtration or the like.

The thus obtained tetracyclo (6. 5. 1. $0^{2,7}$. $0^{9,13}$) tetradecane derivative (III), tetracyclo (7. 4. 0. $0^{3,7}$. $1^{10,13}$) tetradecane derivative (VI) and tetracyclo (7. 4. 0. $0^{2,7}$. $1^{3,6}$) tetradecane derivatives (VII) and (X) all have high densities, i.e., specific gravities of 0.98 or more, but their freezing points are high, on account of which fact they are not desirable as the components of the liquid fuels for rockets and jet engines. However, when these compounds are isomerized by the use of an acid catalyst, a tetracyclo (7. 3. 1. $0^{2,7}$. $1^{7,11}$) tetradecane derivative can be obtained which is represented by the following general formula:

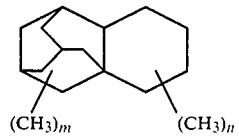

(I)

wherein each of m and n is 0, 1 or 2, but the sum of m and n is 2 or less.

The freezing point of the thus obtained derivative is as low as a level of −70° C. or less, whereby properties which the high-density fuel oil should have can be improved remarkably.

Accordingly, in the manufacturing process for the high-density fuel oil according to the present invention, this isomerization reaction is important, and the compound (III), (VI), (VII) or (X) must be converted absolutely into the tetracyclo (7. 3. 1. $0^{2,7}$. $1^{7,11}$) tetradecane derivative (I). That is, in performing this isomerization reaction, it is undesirable that some of the compound (III), (VI), (VII) or (X) remains in an unreacted state in the system or that it merely changes from an endo form to an exo form. It is thus necessary and essential that the compound (III), (VI), (VII) or (X) is isomerized into the product (I) completely.

Examples of the acid catalysts used in this isomerization reaction include aluminum chloride, aluminum bromide, iron chloride, tin chloride, titanium chloride, sulfuric acid, hydrochloric acid, hydrogen fluoride, boron trifluoride, antimony pentafluoride, trifluoromethanesulfonic acid and fluorinated sulfonic acids. In addition, as the acid catalysts, there can also be used solid acids such as zeolites and combinations of the zeolites and metals, for example, Mg, Ca, Sr, Ba, B, Al, Ga, Se, Pt, Re, Ni, Co, Fe, Cu, Ge, Rh, Os, Ir, Mo, W and Ag. Since the isomerization reaction is a rearrangement reaction in which a (2. 2. 1) heptane skeleton is largely changed into a (3. 3. 1. $1^{3,7}$) decane skeleton as in the formulae (3), (6) or (10), it is desirable to make use of an acid catalyst such as aluminum chloride which has a high acid strength, but an acid catalyst such as hydrochloric acid which is not so high in acid strength can also be used to complete the isomerization reaction, on condition that the reaction is made for a prolonged period of time. The acid catalyst can be used in an amount of 0.1 to 20% by weight, preferably 1 to 10% by weight based on a weight of the compound (III), (VI), (VII) or (X).

This isomerization reaction can be carried out in the asbsence or presence of a solvent such as an aliphatic saturated hydrocarbon or a halogenated saturated hydrocarbon. Examples of the solvents used herein include hexane, heptane, decane, methylene chloride, methylene bromide, chloroform, 1,2-dichloroethane, 1,2-dichloropropane and 1,4-dichlorobutane. The amount of the solvent to be used is not particularly limited, but in general, it is used in an amount 1 to 6 times as much as the weight of the compound (III), (VI), (VII) or (X).

The reaction temperature is within the range of −20° to 100° C., preferably 10° to 80° C., and reaction time is usually within the range of 0.1 to 10 hours, depending on the reaction temperature and the other conditions.

In the practice of the isomerization reaction, any of a batch system, a semi-batch system and a continuous system can be employed. After the catalyst has been separated out or inactivated, the isomerized product is purified by means of distillation or the like.

Now, reference to functional effects of the present invention will be made.

The thus synthesized tetracyclo (7. 3. 1. $0^{2,7}$. $1^{7,11}$) tetradecane derivative (I) is represented by the general formula (I)

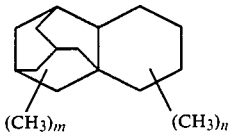

wherein each of m and n is 0, 1 or 2, but the sum of m and n is 2 or less.

This derivative has a high density, a great calorific value, a freezing point of −70° C. or less, and an excellent fluidity at a low temperature.

Another feature of the tetracyclo (7. 3. 1. $0^{2,7}$. $1^{7,11}$) tetradecane derivative (I) which is the main component of the high-density fuel oil according to the present invention is that its manufacturing cost is low. That is, the tetracyclo (6. 5. 1. $0^{2,7}$. $0^{9,13}$) tetradecane derivative (III), the tetracyclo (7. 4. 0. $0^{3,7}$. $1^{10,13}$) tetradecane derivative (VI) and the tetracyclo (7. 4. 0. $0^{2,7}$. $1^{3,6}$) tetradecane derivatives (VII) and (X), which are the intermediate products of the final product (I), can be manufactured by the use of inexpensive raw materials such as butadiene, isoprene, piperylene or dimethylbutadinene; cyclopentadiene, methylcyclopentadiene, dicyclopentadiene, methyldicyclopentadiene or dimethyldicyclopentadiene; a tetrahydroindene derivative; and an indene derivative. In addition, the isomerization of these hydrides (III), (VI), (VII) and (X) can be carried out at a low temperature and in a high yield. Therefore, the liquid fuel of the present invention has the advantage that it can be manufactured at a lower cost than conventional jet fuel. Moreover, the liquid fuel of the present invention has additional advantages, i.e., a good chemical stability, a long-term storage stability and no corrosion to metals.

The liquid fuel of the present invention can be used alone as a fuel for a rocket or a jet engine but may be mixed with a known liquid fuel. The known fuels which can be mixed with the liquid fuel of the present invention include exotetrahydrodicyclopentadienes, a hydride of norbornadiene dimer which is known as RJ-5, a hydride of cyclopentadiene and methylcyclopentadiene trimer (Japanese Unexamined Patent Publication No. 59820/1982), di- or tricyclohexyl alkanes (U.K. Pat. No. 977322), mono- or dicyclohexyl-dicyclic alkanes (U.K. Pat. No. 977323), and naphthenic hydrocarbons and isoparaffinic hydrocarbons (Japanese Patent Application No. 139186/1982).

Now, the present invention will be described in detail in reference to examples, but the latter do not intend to limit a scope of the present invention.

EXAMPLE 1

Reactions in this example progress as follows:

(1)

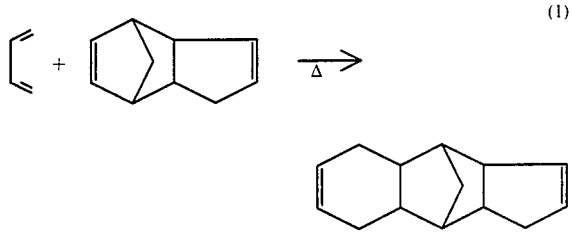

(II-1)

(2)

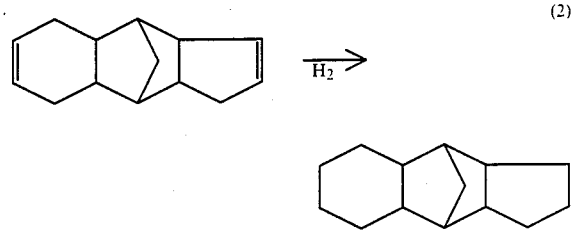

(III-1)

(3)

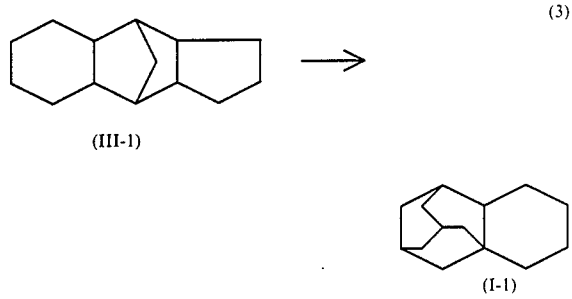

(III-1)

(I-1)

In a 2-liter stainless steel autoclave, the interior atmosphere of which had been replaced with nitrogen, were placed 399 g of dicyclopentadiene and 432 g of butadiene, and reaction was then performed with stirring at 148° C. for 13 hours. After the completion of the reaction, unreacted butadiene and cyclopentadiene were purged, and the resulting reaction solution was then subjected to reduced pressure distillation, so that 99 g of unreacted dicyclopentadiene was recovered and a 1:1 adduct (II-1) (82° C./0.5 mmHg) of butadiene and dicyclopentadiene was obtained in an amount of 293 g. In this Diels-Alder reaction, the reaction proportion of dicyclopentadiene was 75%, and yield of the 1:1 adduct (II-1) from butadiene and dicyclopentadiene was 53%.

Hydrogenation of the 1:1 adduct (II-1) was carried out as follows:

In a 1-liter stainless steel autoclave were placed 290 g of the above mentioned 1:1 adduct (II-1) and 3.1 g of palladium-carbon in which 5% of palladium was supported, and reaction was performed at 40° C., maintaining a hydrogen pressure at 10 kg/cm$^2$. At the point of time when 12 hours had elapsed after the begining of the reaction, the supply of hydrogen was stopped in order to confirm that hydrogen was not absorbed any more, and the reaction was thus brought to an end. After the catalyst had been filtered off, reduced pressure distillation was carried out, so that a hydride (III-1) (106° C./3 mmHg) of the 1:1 adduct from butadiene and dicyclopentadiene was obtained in an amount of 288 g.

The thus obtained hydride (III-1) was isomerized as follows:

In a 2-liter three-necked flask equipped with a stirrer, a cooling pipe and a dropping funnel were 12 g of aluminum chloride and 250 ml of 1,2-dichloroethane, and a solution of 290 g of the above hydride (III-1) in 250 ml of 1,2-dichloroethane was then added slowly thereto with stirring over 2 hours at room temperature through the dropping funnel. Afterward, the reaction was further continued at 45° C. for 3 hours.

After the completion of the reaction, water was added thereto to decompose the aluminum chloride, and the oil layer was washed with water. Dehydration and reduced pressure distillation were then carried out, so that a fraction having a boiling point of 83° C./3 mmHg was obtained in an amount of 278 g.

This product gave an only one peak, when analyzed by a gas chromatography in which a 50-m-long quartz capillary column coated with silicon OV101 was employed. Further, in accordance with mass spectrometry, it was confirmed that a molecular weight of this product was 190. Furthermore, $^{13}$C-NMR analysis made it apparent that the obtained product was tetracyclo (7. 3. 1. $0^{2,7}$. $1^{7,11}$) tetradecane (I-1).

With regard to the tetracyclo (7. 3. 1. $0^{2,7}$. $1^{7,11}$) tetradecane (I-1), the freezing point was −70° C. or less, specific gravity was 1.002 (15° C./4° C.), net calorific value was 10,100 cal/g, and viscosity was 145 cSt (−20° C.).

EXAMPLE 2

Reactions in this example progress as follows:

(1)

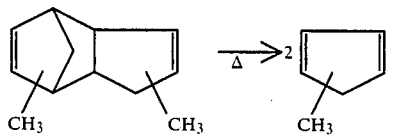

(2)

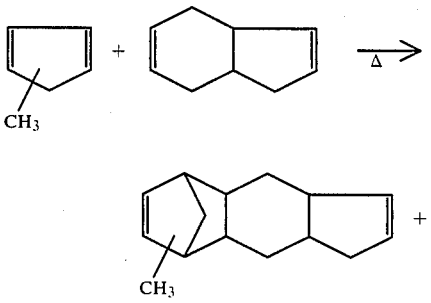

(IV-1)

-continued

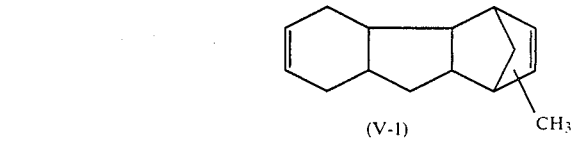

(V-1)

(3)

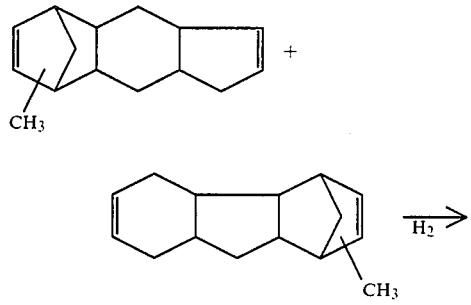

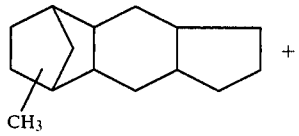

(VI-1)

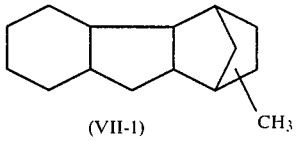

(VII-1)

(4)

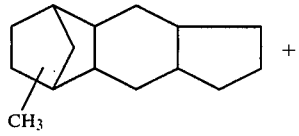

(VI-1)

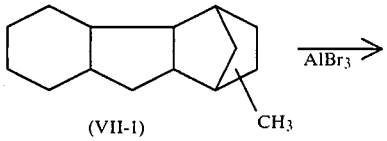

(VII-1)

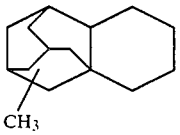

(I-2)

In a 2-liter stainless steel autoclave, nitrogen replacement was accomplished, and 560 g of dimethyldicyclopentadiene and 362 g of tetrahydroindene were placed therein. Reaction was then performed with stirring at 165° C. for 15 hours. After the completion of the reaction, the resulting reaction solution was subjected to reduced pressure distillation, so that there were obtained 177 g of unreacted tetrahydroindene and 269 g of 1:1 adducts (IV-1) and (V-1) (96° to 99° C./0.7 mmHg) of methylcyclopentadiene and tetrahydroindene. The resulting fraction was then analyzed by the use of a gas chromatography, and it was confirmed that 38% of (IV-1) and 62% of (V-1) were contained therein.

Hydrogenation reaction was then carried out in the same manner as in Example 1, as follows: In a 1-liter stainless steel autoclave were placed 265 g of a mixture of the above 1:1 adducts (IV-1) and (V-1) and 3.0 g of platinum-carbon in which 5% of platinum was supported, and the reaction was then performed at 50° C. for 8 hours, maintaining a hydrogen pressure at 15 kg/cm$^2$. After the completion of the reaction, the used catalyst was filtered off, and the resulting reaction solution was subjected to reduced pressure distillation, so that a hydride of the above 1:1 adduct was obtained in an amount of 260 g. This hydride was a mixture of monomethylated tetracyclo (7. 4. 0. $0^{3,7}$. $1^{10,13}$) tetradecane (VI-1) and monomethylated tetracyclo (7. 4. 0. $0^{2,7}$. $1^{3,6}$) tetradecane (VII-1), but these components subsequently underwent isomerization reaction without separating them from each other.

In a 2-liter three necked flask, nitrogen replacement was accomplished, and 200 ml of hexane was then placed therein. Afterward, 10.3 g of aluminum bromide was added thereto with stirring. On the other hand, a solution was beforehand prepared in which 221 g of the hydride [a mixture of the compounds (VI-1) and (VII-1)] of the above 1:1 adduct was dissolved in 250 ml of hexane, and the thus prepared solution was added to the above three necked flask with stirring over 1.5 hours at room temperature through a dropping funnel. After this addition, the reaction temperature was elevated to 55° C., and the reaction was further continued for 8 hours. According to the gas chromatography analysis, it was confirmed that the raw materials (VI-1) and (VII-1) vanished absolutely, and the reaction was then brought to an end. The resulting reaction solution was washed with water, and reduced pressure distillation was then carried out, so that monomethylated tetracyclo (7. 4. 1. $0^{2,7}$. $1^{7,11}$) tetradecane (I-2) (90° C./1 mmHg) was obtained in an amount of 215 g.

In the case of this isomeric compound, the freezing point was −70° C. or less, specific gravity was 0.994 (15° C./4° C.), and net calorific value was 10,200 cal/g.

EXAMPLE 3

Reactions in this example progress as follows

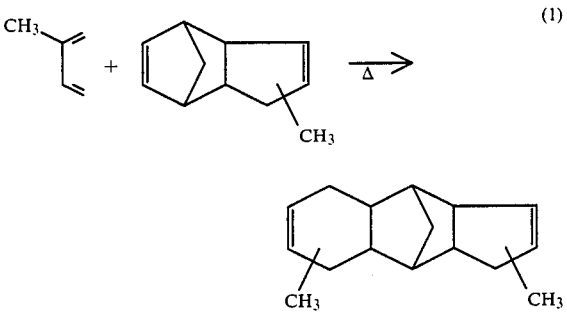

(1)

(II-2)

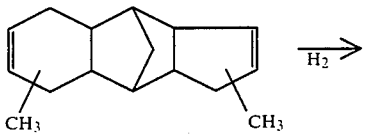

(2)

(II-2)

-continued

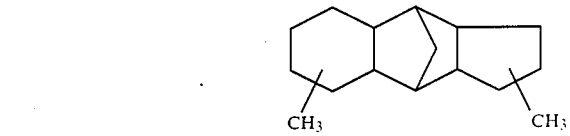

(III-2)

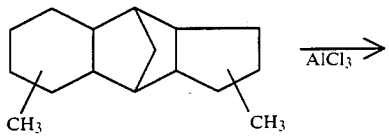

(3)

(III-2)

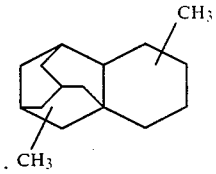

(I-3)

In the same manner as in Example 1 or 2 described above, 292 g of methyldicyclopentadiene was allowed to react with 320 g of isoprene at 130° C. for 18 hours. After the reaction had been over, reduced pressure distillation was accomplished, so that a 1:1 adduct (II-2) of methyldicyclopentadiene and isoprene was obtained in an amount of 178 g.

Hydrogenation of the thus obtained adduct was then carried out by the use of a Raney nickel, as follows:

In a 500-milliliter stainless steel autoclave were placed 170 g of the above adduct (II-2), 100 ml of toluene and 1.1 g of the activated Raney nickel, and they were then stirred. Hydrogen was added thereto continuously so as to maintain a pressure therein at 15 kg/cm$^2$, while a reaction temperature was maintained at 30° C. At the point of time when 8 hours had elapsed after the beginning of the reaction, the supply of hydrogen was stopped and, it was observed whether or not the pressure therein dropped, whereby it was appreciated that no hydrogen was consumed any more. The resulting reaction solution was then taken out therefrom, and the used catalyst was filtered off under a nitrogen gas stream. Afterward, the reaction solution was subjected to reduced pressure distillation, so that dimethylated tetracyclo (6. 5. 1. $0^{2,7}$. $0^{9,13}$) tetradecane (III-2) was obtained in an amount of 168 g.

Isomerization of the thus obtained hydride (III-2) was carried out in the same manner as in Example 1 or 2, as follows:

In a 500-milliliter three necked flask were placed 100 ml of dichloroethane and 5 g of aluminum chloride, and a solution of 100 g of the above hydride (III-2) in 100 ml of dichloroethane was added dropwise thereto over 2 hours at room temperature. After this addition, the solution temperature was elevated to 50° C. and the reaction was further continued for 2 hours. According to the gas chromatography analysis, it was confirmed that the raw material (III-2) had reacted absolutely, and the reaction was then brought to an end. The resulting reaction solution was washed with water and was then subjected to reduced pressure distillation, so that dimethylated tetracyclo (7. 3. 1. $0^{2,7}$. $1^{7,11}$) tetradecane (I-3) was obtained in an amount of 92 g.

With regard to this isomeric compound, the freezing point was −70° C. or less, specific gravity was 0.986 (15° C./4° C.), and net calorific value was 10,300 cal/g.

EXAMPLE 4

Reactions in this example progress as follows:

(1)

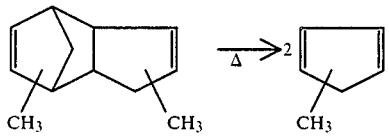

(2)

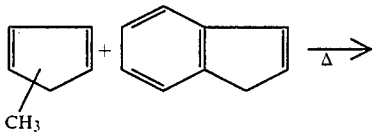

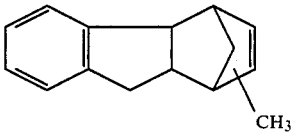

(VIII-1)

(3)

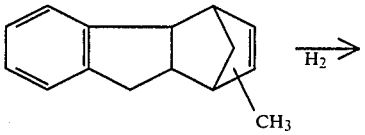

(VIII-1)

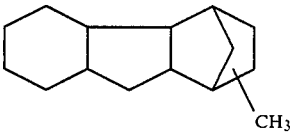

(X-1)

(4)

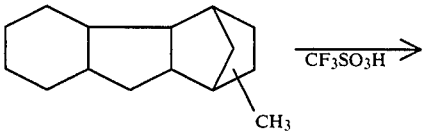

(X-1)

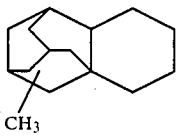

(I-4)

In a 2-liter stainless steel autoclave, nitrogen replacement was accomplished, and 640 g of dimethyldicyclopentadiene and 232 g of indene were then placed therein. Afterward, reaction was performed at 170° C. for 18 hours. After the completion of the reaction, the resulting reaction solution was subjected to reduced pressure distillation, so that a 1:1 adduct (VIII-1) of indene and methylcyclopentadiene was obtained in an amount of 211 g.

Next, 190 g of the thus obtained 1:1 adduct (VIII-1), 8 g of rhodium (5%)-carbon and 300 ml of methanol were placed in a 2-liter stainless steel autoclave, and reaction was then performed at 60° C. for 18 hours, while a hydrogen pressure was maintained at 30 kg/cm$^2$. After the reaction was over, the used catalyst was filtered off, and the reaction solution was then subjected to reduced pressure distillation, so that a hydride (X-1) of the above 1:1 adduct was obtained in an amount of 173 g.

Isomerization reaction of this hydride was accomplished in the same manner as in Example 1 or 2, as follows:

In a 1-liter three necked flask were placed 15 g of trifluoromethanesulfonic acid and 150 ml of 1,3-dichloropropane, and a solution of 153 g of the above hydride (X-1) in 200 ml of 1,2-dichloropropane was added thereto at room temperature over 2 hours. After this addition, the reaction temperature was elevated up to 80° C., and the reaction was then continued additionally for 10 hours. After the completion of the reaction, the resulting reaction solution was washed with water, and reduced pressure distillation was carried out, so that monomethylated tetracyclo (7. 3. 1. $0^{2,7}$. $1^{7,11}$) tetradecane (I-4) was obtained in an amount of 142 g. With regard to this isomeric compound, the freezing point was −70° C. or less, specific gravity was 0.992, and net calorific value was 10,170 cal/g.

What is claimed is:

1. A method of operating an engine by combusting a fuel oil therein, said fuel oil comprising a hydrocarbon, the improvement which comprises employing a fuel oil containing a tetracyclo (7. 3. 1. $0^{2,7}$. $1^{7,11}$) tetradecane derivative represented by the general formula:

(I)

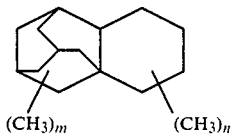

wherein each of m and n is 0, 1 or 2, and the sum of m and n is 2 or less.

2. A method according to claim 1 in which said derivative has a freezing point of −70° C. or less.

3. A method according to claim 2 in which m and n are zero.

4. A method according to claim 2 in which n is 1 and n is zero.

5. A method according to claim 2 in which m and n are each 1.

6. A method according to claim 1 wherein said derivative is employed in combination with another rocket or jet engine fuel oil.

* * * * *